United States Patent [19]

Booker

[11] 4,103,458

[45] Aug. 1, 1978

[54] SECURING OF DOORWAYS

[75] Inventor: Ernest R. Booker, Teddington, England

[73] Assignee: Plan Partitions Limited, London, England

[21] Appl. No.: 750,389

[22] Filed: Dec. 14, 1976

[30] Foreign Application Priority Data

Jun. 21, 1976 [GB] United Kingdom ..... 25678/76
Sep. 17, 1976 [GB] United Kingdom ..... 38525/76

[51] Int. Cl.[2] ..... E06B 7/08

[52] U.S. Cl. ..... 49/56; 160/97; 160/114

[58] Field of Search ..... 160/31, 32, 40, 88, 160/92, 97, 114, 131, 183, 352, 351; 49/50, 56, 58–60, 94, 395, 71; 52/63, 64, 71

[56] References Cited

U.S. PATENT DOCUMENTS

| | | | |
|---|---|---|---|
| 948,628 | 2/1910 | Jefferis | 49/395 |
| 1,036,801 | 8/1912 | Couplin | 160/88 |
| 1,204,833 | 11/1916 | Warfel | 160/97 |
| 1,479,312 | 1/1924 | O'Harrow | 49/71 |
| 1,503,538 | 8/1924 | Kugler | 160/92 |
| 1,745,299 | 1/1930 | Holan | 160/88 |
| 2,455,112 | 11/1948 | Christison | 160/114 |
| 2,690,797 | 10/1954 | Erikson | 160/88 |
| 2,938,248 | 5/1960 | Hadary | 160/351 |

*Primary Examiner*—Peter M. Caun
*Attorney, Agent, or Firm*—Larson, Taylor and Hinds

[57] ABSTRACT

A conventional doorway, of the kind capable of opening in one direction only, is adapted to resist forceful entry by a caller, even after initial opening of the door by an occupant, due to the presence of a generally rectangular and at least partially translucent closure member which is secured to either the door or the door frame, is movable towards and away from an operative position in which it engages respectively either the door frame or the door, and includes means allowing it to be releasably secured in said operative position to prevent opening of the door through more than a predetermined angle, the closure member then bridging the gap which would otherwise have appeared between the door and the door frame so that entry through the doorway by the caller is denied until said means securing the closure member has been released by the occupant.

10 Claims, 11 Drawing Figures

SECURING OF DOORWAYS

Almost all countries are suffering from rising crime, a particularly disturbing feature being the sharp increase in crimes of violence, such as rape or armed robbery, committed after forcing entry to occupied premises.

In an attempt to protect themselves, many private households, hotels and businesses instal chains which can be releasably secured between a door and an adjacent door frame to limit the extent to which the door can be opened. Unfortunately, it is now common knowledge amongst criminals that in spite of such precautions, entry can still be forced by jamming a block of wood in the narrow opening between the door and the door frame, and then cutting through the chain with a pair of metal cutters. In an endeavour to avoid even limited opening, doors have been fitted with fish-eye lenses allowing an initial panoramic visual inspection to be made when the doors are closed, but the necessary broad field of vision has only been obtained at the expense of severe distortion. A disadvantage of this is that any documents proving a caller's identity cannot be read through the lens, with the result that the door still has to be opened.

According to the present invention, a doorway comprises a generally rectangular door which is pivotally carried by a door frame in a manner allowing movement of the door in one direction only out of the plane of the door frame, the doorway being capable of resisting forceful entry by a caller, even after initial opening of the door by an occupant, due to the presence of a generally rectangular and at least partially translucent closure member which is secured to either the door or the door frame, is movable towards and away from an operative position in which it engages respectively either the door frame or the door, and includes means allowing it to be releasably secured in said operative position to prevent opening of the door through more than a predetermined angle, the closure member then bridging the gap which would otherwise have appeared between the door and the door frame so that entry through the doorway by the caller is denied until said means securing the closure member has been released by the occupant.

It should be noted that the term door frame is intended to cover adjacent portions of a surrounding wall as well as a lintel and pair of door posts secured to that wall.

In a particularly preferred embodiment of the present invention, the closure member is formed as a frame from lengths of extruded aluminium section which have been secured to one another to support a pair of windows formed of a transparent bullet-resistant laminated glass, the entire length of one vertical edge of the frame being hinged to an L-shaped bracket fixed to one of the door posts forming part of said door frame, and the entire length of the other vertical edge of the frame including a flange constituted by one of said lengths of aluminium which has been extruded to L-section.

In use, the frame is swung to an operative position in which the flange lies in the path of movement of the door, the frame then being secured in that position by moving a bolt carried by a lower portion of the frame into a socket set into the adjacent floor. Clearly, the door can then be opened in perfect safety, entry through the doorway being prevented because of the obstruction caused by the flange on the frame. An occupant of the premises opening the door is thus protected against attack from the front whilst he examines the credentials of a caller through the windows. If satisfied, entry through the doorway is permitted by the occupant releasing the bolt from the floor and returning the frame to its initial inoperative position.

It will be appreciated that when the door is prevented from opening through more than a predetermined angle, the door and the frame together form an inwardly-projecting barrier which extends continuously across the width of the doorway, but which still leaves a triangular opening between upper portions of the door and the frame and the door frame. Preferably, this triangular opening is closed by a canopy which is permanently secured to the lintel, or to any brickwork or concrete immediately thereabove, forming part of said door frame. Indeed, an upper portion of the frame preferably carries a further bolt for movement into and out of a further socket set into said canopy, and if so the floor and the canopy bolts may be simultaneously movable in response to operation of a single central control formed as an Espanolette lock. The mechanical bolts may be replaced, if desired, by other kinds of securing means, such as electrically operated locks or bolts.

The reader will appreciate that a considerable number of doorways embodying the present invention could readily be constructed by any competent designer. Although we cannot hope to list all of the modifications which could be made, the following examples should be regarded as typical alternatives to the preferred doorway described above.

In one alternative, both the floor and the canopy bolts are omitted, the frame being pivotally secured to one of the door posts by a spring-loaded ratchet and pawl arrangement. The frame is free to swing away from an inoperative position in which it lies against the wall, but cannot swing back past its operative position until it has been released by the occupant lifting the ratchet over the pawl against the bias of the spring.

In another alternative, the frame is replaced by a collapsible closure member, such as a concertina-like folding partition or a lazytong-like lift gate, which is secured to the door frame and may be in continuous co-operative association with an upper and/or lower track by which it is guided whenever it is collapsed or extended. Although a folding partition would preferably include several of the windows utilised in the preferred embodiment of the invention, in order to be at least partially translucent, a lift gate would not require such windows because of the openings which would automatically appear whenever its lazytong-like construction was extended.

In yet another alternative, the frame is pivotally secured at or near the free vertical edge of the door, the free vertical edge of the frame carrying a pair of upwardly and downwardly projecting ball-headed spigots which can releasably engage in a pair of slots formed in respective metal slides attached to the wall. The slots must, of course, be open at their ends further from the door to enable the spigots to enter, the other ends of the slots being closed.

In use, as the door is opened by the occupant, the frame pivots and the spigots are progressively drawn along the slides until they reach the closed ends of the slots, whereupon further opening of the door is prevented, the frame having continuously bridged the gap which would otherwise have appeared between the door and the door frame. To release the frame, the door must be shut to return the spigots to the open ends of the slots, from which they can then be removed by further pivoting of the frame relatively to the door.

When not in use, the frame can be folded back to an inoperative position in which it lies against the door and is retained by, for example, a magnetic catch. Alternatively, that edge of the frame which is pivotally secured to the door may be itself formed with a pair of upwardly and downwardly projecting ball-headed spigots, the spigots engaging in respective slots formed in a further pair of metal slides secured to the door. In such an arrangement, however, the slots in the further slides must be closed at both ends to prevent the frame becoming separated therefrom. Clearly, when not in use, the frame can be slid along the further slides to said inoperative position in which it again lies flat against the door.

In all of the above-described modifications, the width of the closure member is preferably from twelve to eighteen inches, thereby allowing the invention to function satisfactorily with a door having a width of from thirty to thirty-six inches. The transparent bullet-resistant glass, if present, is preferably at least three-quarters inch thick, and may be coloured by tinting or by the presence of a coloured intermediate laminate. Moreover, the edges of the glass can be shaped, in a known manner, to enhance speech communication between an occupant and a caller, although the closure member could alternatively be fitted with any known system of electronic voice enhancement. The windows may be covered by wire mesh, and indeed the closure member need be no more than four lengths of a shock-resistant material secured to one another to form an open rectangle which is itself secured to and covered by wire mesh.

It will be apparent that in some of the above-described doorways, the free vertical edge of the door is not in continuous contact with the closure member, a very narrow gap being present until the door can be opened no further. To avoid such very narrow gaps, it is envisaged that the closure member could be curved, instead of being essentially flat, to a radius equal to that swept out by said free vertical edge of the door.

Several doorways according to the present invention will now be described, by way of example only, with reference to the accompanying drawings, in which:

FIG. 1 is a schematic perspective view of a preferred doorway according to the present invention shown in its secured position;

FIGS. 2 and 3 are sections taken respectively along the lines 2—2 and 3—3 of FIG. 1;

It should be noted that like numerals will be used throughout when referring to component parts of like utility, differences of construction being identified by the use of appropriate subscripts, thereby rendering unnecessary a largely repetitive discussion of each of the alternative doorways to be described hereinbelow.

Figure 1:
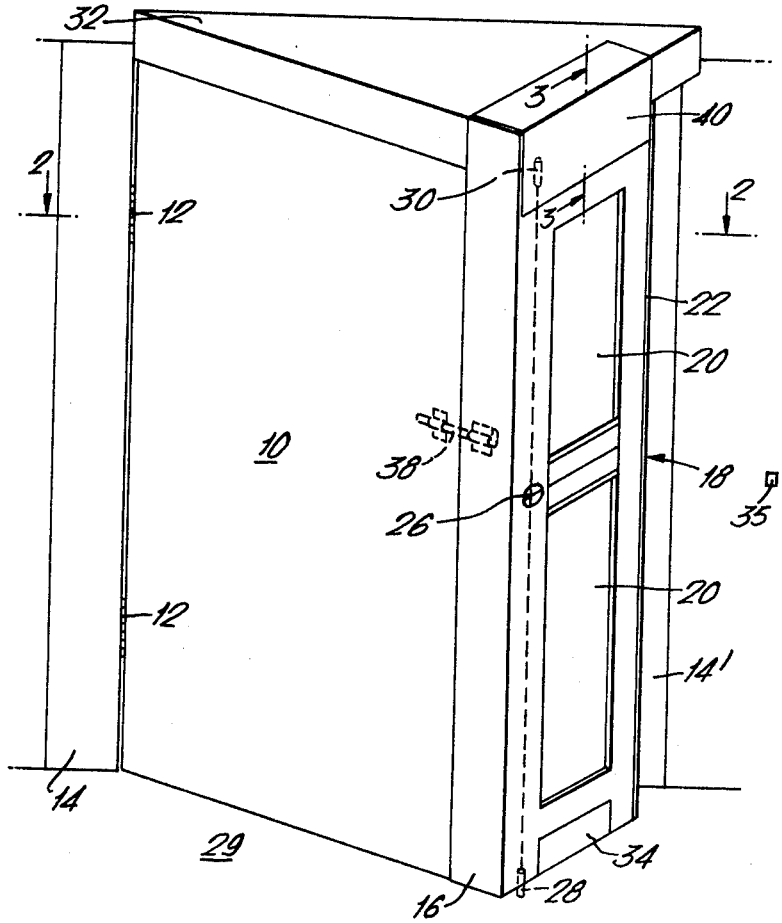
Figure 2:
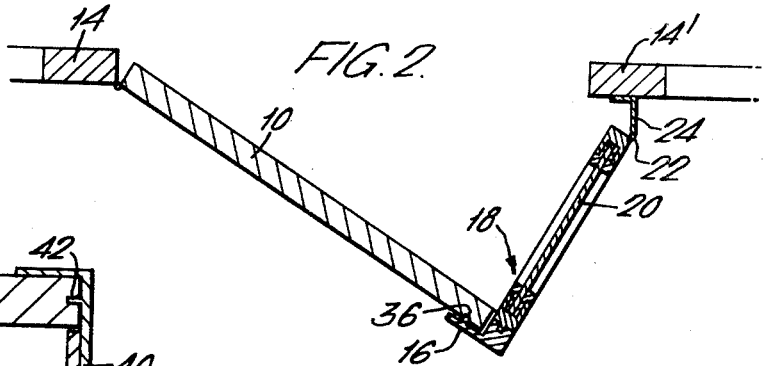
Figure 3:
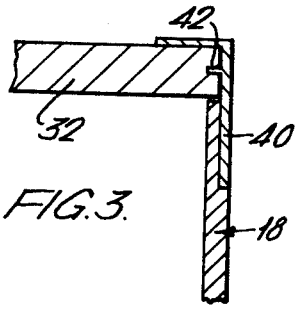

Referring firstly to FIGS. 1 to 3, a generally rectangular door 10 of conventional construction is shown pivotally mounted by hinges 12 to a post 14 of an adjacent door frame. The door can be swung open in one direction only out of the plane of the door frame to permit access through the doorway, but can preferably also be held shut by a locking catch (not shown) capable of releasable co-operation with an opposed post 14′ of the door frame. In fact, the door 10 is shown in an intermediate position in which it has been opened to the fullest extent allowable by an abutment constituted by a flange 16 formed along the entire length of one vertical edge of a closure member.

The closure member is constructed, by well known techniques, from lengths of extruded aluminium section which have been secured to one another to form a generally rectangular frame 18 which supports one or more, preferably a pair, of panes 20 of three-quarters inch thick transparent bullet-resistant laminated glass. The flange 16 may be secured to said vertical edge of the frame 18 by, for example, screwing, gluing or welding, but is preferably formed integrally therewith as an extruded length of L-section. The entire length of the other vertical edge of the frame is pivotally mounted by a hinge 22 to an L-shaped bracket 24, which is itself firmly secured by screws (not shown) to the door frame post 14′.

It should be noted that the materials chosen for the flange 16 and/or the frame 18 will be influenced by economic and aesthetic considerations, but are most likely to be chosen from the following: aluminium, stainless steel, wrought iron, timber or laminated plastics materials. The frame is thus preferably imperforate and non-collapsible, being formed of an opaque material having at least one window of a translucent material set therein.

The frame 18 can be swung to an operative position, shown most clearly in FIG. 2, where it can then be secured by turning a centrally located lock 26 which is operatively linked to a bolt 28 (shown in dotted outline) movable into and out of a socket formed in an adjacent floor 29, as well as being operatively linked to a bolt 30 (again shown in dotted outline) movable into and out of a further socket formed in a canopy 32. The floor bolt 28 and the canopy bolt 30, which are clearly carried by lower and upper portions respectively of the frame 18, are thus simultaneously movable in response to operation of a single central control, with either the floor bolt 28 or the canopy bolt 30 or both constituting means for releasably securing the frame 18 in its above-mentioned operative position where it prevents opening of the door 10 through more than a predetermined angle.

The canopy 32, which may be formed of, for example, concrete or blockboard, is permanently secured to a lintel (not shown) forming part of the door frame. A triangular opening which would otherwise appear between upper portions of the door 10 and the frame 18 and said lintel, when the frame 18 is in its operative position, is thus closed by said canopy 32, thereby protecting an occupant against attack from above. Attack from below is preferably resisted by providing a substantial part of the width of the lower portion of the frame 18 with a kickboard 34 formed of e.g. wood, such as 2 inch thick blockboard. The provision of the kickboard 34 also means that the height of the frame 18 can be readily reduced, by sawing through the blockboard and its two retaining legs of aluminium, thereby enabling a given frame size to be modified to fit different sizes of previously unprotected doorways. When not in use, the frame 18 can be retained in an inoperative position, where it cannot prevent opening of the door 10, by for example a magnetic or mechanical catch shown schematically at 35 in FIG. 1.

The flange 16 is formed with a series of longitudinally-spaced spigots 36 (only one of which is shown in FIG. 2) constituting male fastenings which can co-operate with corresponding recesses formed in the door 10 and constituting female fastenings. Clearly, in an alternative arrangement, the door could be formed with the spigots, the flange then being formed with a corresponding series of apertures. It has been found that positively locating the door 10 with respect to the frame 18 in this manner provides extra strength should the doorway be subjected to attack. However, as a further safeguard, a bolt 38 can be mounted on the flange 16 for releasable co-operation with a hasp secured to the door.

FIG. 3 shows that the uppermost edge of the frame 18 carries an upstanding L-shaped aluminium hood 40. The hood 40, together with said uppermost edge, thus define a channel-shaped recess for receiving a part of the canopy 32 when the frame 18 is in its operative position. The hood 40 is in many respects similar to the flange 16, and in particular may be formed with a series of longitudinally-spaced spigots 42 or holes (not shown) which can co-operate, respectively, with corresponding recesses formed in or studs carried by the canopy 32. Again it has been found that the resultant doorway exhibits increased resistance to attack, particularly when the attack takes the form of leverage directed towards the top or the bottom of the frame.

The manner of operation of the preferred doorway described above is shown schematically in FIGS. 4A, 4B and 4C, the canopy 32 having been omitted for the purpose of clarity.

Figure 4A:
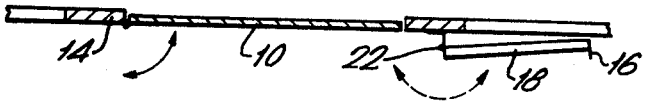
FIGS. 4A, 4B and 4C are schematic plan views showing the preferred doorway at different stages of being secured.
Figure 4B:
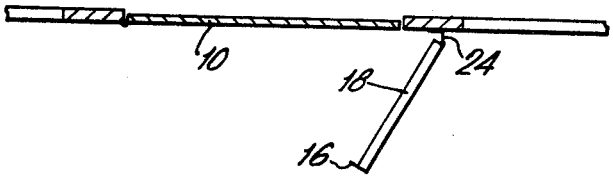

Initially, the frame 18 lies in its inoperative position as shown in FIG. 4A. However, to render the doorway capable of resisting forceful entry by a caller, even after initial opening of the door 10 by an occupant, the frame 18 should be pivoted to its operative position, as shown in FIG. 4B, and should then be bolted in that position by operation of the central lock 26. It will be apparent from FIG. 4C that the flange 16 lies in the path of movement of the door 10, thereby preventing opening of the door through more than a predetermined angle. In effect, therefore, the frame 18 bridges the gap which would otherwise have appeared between the door and the door frame so that entry through the doorway by the caller is denied until said central lock 26 has been operated by the occupant to release both the floor bolt 28 and the canopy bolt 30.

Figure 5:
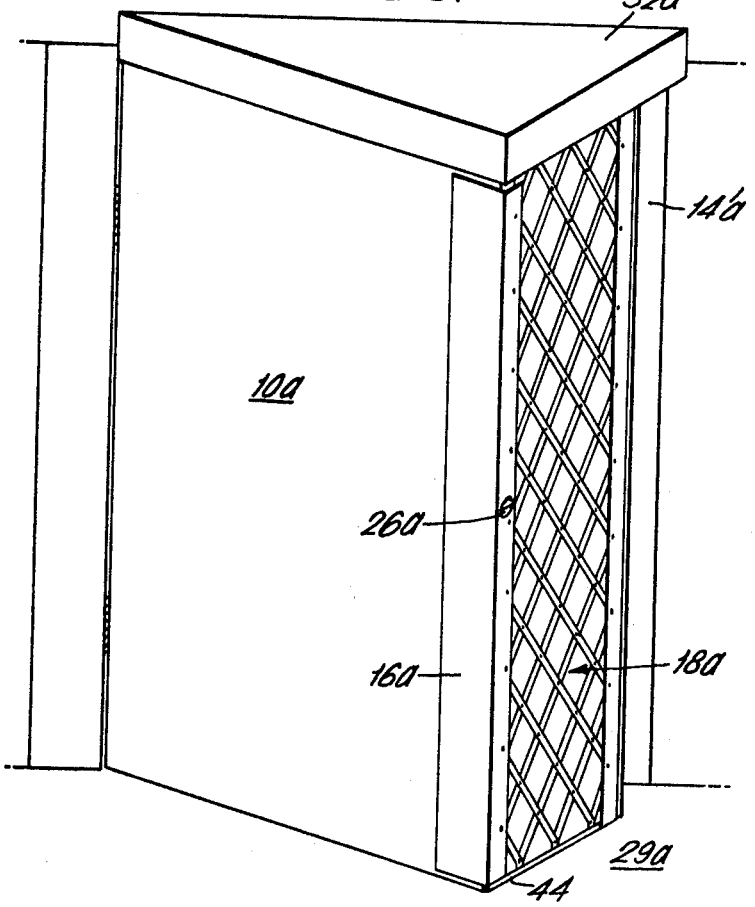
FIG. 5 is similar to FIG. 1 but shows a collapsible closure member formed as a lift gate.

A modification of the preferred doorway described above is shown in FIG. 5, in which the closure member is formed as a collapsible lift gate 18*a*, one vertical edge of which is secured to a door post 14*a*′ and its other vertical edge being formed with a flange 16*a*. Preferably, the lift gate 18*a* is in continuous co-operative association with both a lower track 44 carried by a floor 29*a*, and an upper track (not shown) carried by a canopy 32*a*, the two tracks acting to guide the lift gate 18*a* whenever its lazytong-like construction is collapsed or extended. If desired, one of the two tracks may be omitted. The lift gate 18*a* may, as in the preferred embodiment, be releasably secured in its extended position by operation of a single central lock 26*a*.

Figure 6:
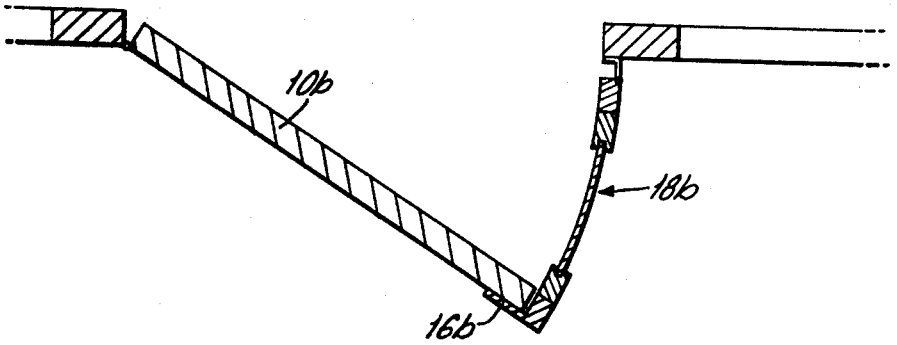
FIG. 6 is similar to FIG. 2 but shows a closure member of curved configuration; and, FIGS. 7A, 7B and 7C are similar to FIGS. 4A, 4B and 4C but show the sequence of securing a modified doorway according to the present invention.

A further modification is shown in FIG. 6, in which a closure member 18*b* is again secured to the door frame, but is curved to a radius equal to that swept out by a door 10*b* upon opening thereof. Consequently, the free vertical edge of the door 10*b* can remain closely adjacent to said closure member throughout its initial opening, continued opening of the door again being prevented by a flange 16*b*.

Figure 4C:
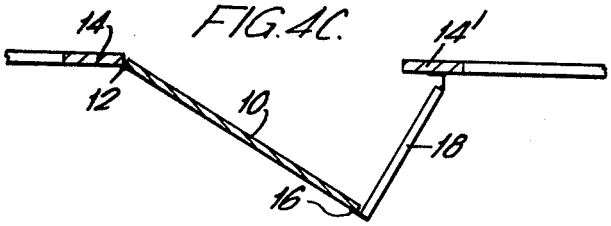
Figure 7A:
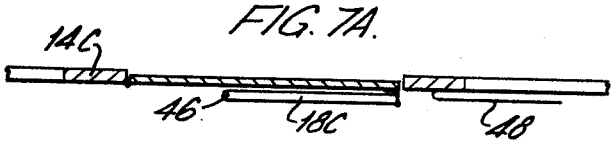
Figure 7B:
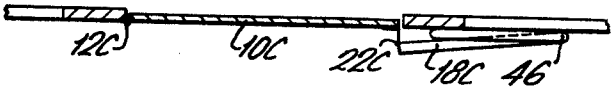
Figure 7C:
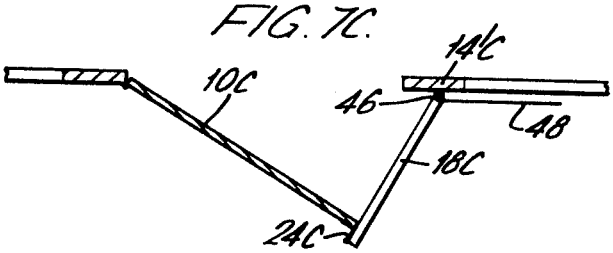

Finally, yet another modified doorway is shown in FIGS. 7A, 7B and 7C, which are based upon and correspond respectively with the above described FIGS. 4A, 4B and 4C. In the present modification, a closure member 18*c* is pivotally secured to a door 10*c*, rather than being pivotally secured to a surrounding door frame, by a hinge 22*c* and braket 24*c*. The free vertical edge of the closure member carries a pair of upwardly and downwardly projecting ball-headed spigots (one of which is shown at 46) which can releasably engage in a pair of slots formed in respective metal slides (one of which is shown at 48) attached to said door frame.

In use, the closure member 18*c* is swung from its inoperative position, as shown in FIG. 7A, about its hinge 22*c* to the position shown in FIG. 7B in which the spigots are capable of entering the right-hand open ends of said slots. If the door 10*c* is then opened, the closure member 18*c* pivots and the spigots are progressively drawn along the slides until they reach the left-hand closed ends of the slots, as shown in FIG. 7C, whereupon further opening of the door is prevented. Naturally, to release the doorway to permit entry of a caller therethrough, the sequence of operations described hereinabove must be reversed.

It has been found that doorways according to the present invention give good protection against a determined attacker, partly because attacks are deflected by virtue of the acuteness of the angle which the closure member makes with the plane of the door frame. As the weakest part of the doorway is probably the door itself, it is envisaged that strengthening frames will be provided for fastening thereto, the strengthening frames being formed of wrought iron to the shape of the doors with decorative infills. It is also envisaged that an attacker could be rendered harmless by release of a disabling fluid, from a container located in the canopy, upon operation of a switch accessible only to the occupant.

I claim:

1. A doorway comprising a generally rectangular door which is pivotally carried by a door frame in a manner allowing movement of the door over an adjacent floor in one direction only out of the plane of the door frame, the door and the floor and the door frame thus constituting respective elements of a conventional doorway, and the present improvement residing in adapting such a conventional doorway to resist forceful entry by a caller, even after initial opening of the door by an occupant, by providing a non-collapsible canopy extending outwardly from the door frame above the door in combination with a generally rectangular closure member formed as a non-collapsible imperforate bullet-resistant member which extends from the floor to the canopy and which includes at least one translucent portion of a bullet-resistant material, the entire length of one vertical edge of the closure member being pivotally hinged to the door frame with the entire length of the other vertical edge of the closure member including a flange extending perpendicular to the main portion of the closure member to form therewith an L-section, both upper and lower portions of the closure member carrying respective bolts which are movable into and out of respective sockets set in said canopy and said floor to secure and release the closure member from an operative stationary position, in which the closure member lies at a predetermined position with the flange lying in the path of movement of the door to prevent subsequent opening of the door through more than a predetermined angle, the closure member and the canopy then bridging the gaps which would otherwise have appeared between the door and the door frame so that entry through the doorway by the caller is denied until said bolts have been released by the occupant.

2. A doorway according to claim 1, wherein the closure member is formed of lengths of opaque bullet-resistant material connected together and leaving at least one portion containing a window of translucent material forming said at least one translucent portion.

3. A doorway according to claim 2, said flange being constituted by one of said lengths, which length is of L-cross-section.

4. A doorway according to claim 1 both bolts being simultaneously activated in response to operation of a single central control.

5. A doorway according to claim 1 in which the uppermost edge of the closure member carries an upstanding L-shaped hood which, together with said uppermost edge, defines a channel-shaped recess for receiving a part of the canopy when the closure member is in its operative position.

6. A doorway according to claim 5 in which the hood and canopy are formed with respective series of longitudinally-spaced spigots and bores therefor which cooperate with one another to strengthen the doorway during attempts to force an entry therethrough.

7. A doorway according to claim 1 in which the flange and the door are formed with respective series of longitudinally-spaced spigots and bores therefor which cooperate with one another to strengthen the doorway during attempts to force an entry therethrough.

8. A doorway according to claim 1 in which said closure member is formed from lengths of extruded aluminium section which have been secured to one another, and a substantial part of the width of a lower portion of the closure member includes a kickboard.

9. A doorway according to claim 1 in which the closure member is curved to a radius equal to that swept out by the door upon opening thereof.

10. A doorway comprising a generally rectangular door which is pivotally carried by a door frame in a manner allowing movement of the door in one direction only out of the plane of the door frame, the door and the door frame thus constituting respective elements of a conventional doorway, and the present improvement residing in adapting such a conventional doorway to resist forceful entry by a caller, even after initial opening of the door by an occupant, by providing a generally rectangular closure member formed as a frame from lengths of extruded aluminium section which have been secured to one another to support a pair of windows formed of a transparent bullet-resistant laminated glass, the entire length of one vertical edge of the frame being hinged to an L-shaped bracket fixed to a door post forming part of said door frame, with the entire length of the other vertical edge of the frame including a flange constituted by one of said lengths of aluminium which has been extruded to L-section, the entire width of the uppermost edge of the frame carrying an upstanding L-shaped extruded aluminium hood, and a substantial part of the width of a lower portion of the frame including a kickboard formed of wood, both upper and lower portions of the closure member carrying respective bolts which are simultaneously movable in response to operation of a single central control to either release or secure the closure member in an operative position, in which the flange lies in the path of movement of the door to prevent opening of the door through more than a predetermined angle, the closure member then bridging the gap which would otherwise have appeared between the door and the door frame so that entry through the doorway by the caller is denied until said bolts have been released by the occupant.

* * * * *